US011092145B2

(12) United States Patent
Erwin et al.

(10) Patent No.: US 11,092,145 B2
(45) Date of Patent: Aug. 17, 2021

(54) PUMP AND VALVE RETAINER ASSEMBLY

(71) Applicant: National Oilwell Varco, L.P., Houston, TX (US)

(72) Inventors: Justin Wade Erwin, Cypress, TX (US); Christopher Eugene Robinson, Tomball, TX (US); Daniel Alan Senechal, Spring, TX (US)

(73) Assignee: National Oilwell Varco, L.P., Houston, TX (US)

( * ) Notice: Subject to any disclaimer, the term of this patent is extended or adjusted under 35 U.S.C. 154(b) by 232 days.

(21) Appl. No.: 16/305,742

(22) PCT Filed: May 31, 2016

(86) PCT No.: PCT/US2016/034968

§ 371 (c)(1),
(2) Date: Nov. 29, 2018

(87) PCT Pub. No.: WO2017/209725

PCT Pub. Date: Dec. 7, 2017

(65) Prior Publication Data

US 2020/0318626 A1 Oct. 8, 2020

(51) Int. Cl.
*F04B 39/12* (2006.01)
*F04B 19/22* (2006.01)
(Continued)

(52) U.S. Cl.
CPC ..... *F04B 39/12* (2013.01); *F04B 19/22* (2013.01); *F04B 39/14* (2013.01); *F04B 53/10* (2013.01); *F04B 53/16* (2013.01); *F04B 53/22* (2013.01)

(58) Field of Classification Search
CPC ..... Y10T 137/7939; Y10T 137/7929; F04B 39/14; F04B 39/12–39/125; F04B 19/22;
(Continued)

(56) References Cited

U.S. PATENT DOCUMENTS 4,550,646 A 11/1985 Miller
9,605,767 B2 * 3/2017 Chhabra ..... B23P 19/00
(Continued)

FOREIGN PATENT DOCUMENTS

WO 2016007174 A1 1/2016

OTHER PUBLICATIONS

International Patent Application No. PCT/US2016/034968 International Search Report and Written Opinion dated Aug. 23, 2016 (13 pages).

*Primary Examiner* — Bryan M Lettman
(74) *Attorney, Agent, or Firm* — Conley Rose. P.C.

(57) ABSTRACT

A valve retainer assembly and pump including the same. In an embodiment, the valve retainer assembly includes a retainer configured to engage with a suction valve assembly and retain the suction valve assembly within a chamber of a fluid section of a reciprocating pump. The retainer includes a pair of engagement arms extending along a single arm axis, and a connecting member including a coupling aperture. In addition, the valve retainer assembly includes a keeper that further includes a keeper axis, and a connecting shaft. The connecting shaft of the keeper is received within the coupling aperture such that the keeper axis extends in a direction that is perpendicular to the arm axis.

19 Claims, 7 Drawing Sheets

(51) Int. Cl.

| | |
|---|---|
| ***F04B 53/10*** | (2006.01) |
| ***F04B 53/16*** | (2006.01) |
| ***F04B 39/14*** | (2006.01) |
| ***F04B 53/22*** | (2006.01) |

(58) Field of Classification Search
CPC ..... F04B 53/007; F04B 53/10–53/1097; F04B 53/16; F04B 53/22; F16K 15/02; F16K 15/021; F16K 15/026
See application file for complete search history.

(56) References Cited

U.S. PATENT DOCUMENTS

| | | | | |
|---|---|---|---|---|
| 2006/0029502 | A1 | 2/2006 | Kugelev et al. | |
| 2007/0295411 | A1* | 12/2007 | Schwegman ..... | F16K 15/063 137/542 |
| 2013/0202458 | A1 | 8/2013 | Byrne et al. | |
| 2014/0086774 | A1 | 3/2014 | Chandrasekaran et al. | |

* cited by examiner

PUMP AND VALVE RETAINER ASSEMBLY

CROSS-REFERENCE TO RELATED APPLICATIONS

The present application is a National Phase entry of, and claims priority to PCT Application No. PCT/US2016/034968, filed May 31, 2016, the entire contents of which are hereby incorporated by reference herein for all purposes.

STATEMENT REGARDING FEDERALLY SPONSORED RESEARCH OR DEVELOPMENT

Not applicable.

BACKGROUND

This disclosure relates generally to reciprocating pumps. More particularly, this disclosure relates to retainer valve assemblies for retaining a valve assembly within the fluid section of a reciprocating pump.

Reciprocating pumps typically include a power end or section that drives the reciprocal translation of a plunger or shaft so as to pressurize fluid within the pump's fluid end or section. One or more valve assemblies are disposed within the fluid section to control the flow of fluid both into and out of the fluid section during operations. Specifically, at least one suction valve assembly is employed within the fluid section to control the flow of fluid into the fluid section (e.g., during a suction stroke of the plunger), and at least one discharge valve assembly is installed within the fluid section to control the flow of fluid that is discharged from the fluid section (e.g., during a discharge stroke of the plunger). In many instances, some sort of retaining system is utilized to secure and retain the valve assemblies within the fluid section and to ensure their proper performance during reciprocation of the plunger and pumping of the fluid. Many conventional retaining systems induce stress concentrations at the corners of fluid passages within the housing or main body of the fluid section, such that stresses at these locations may be excessive during operations. As a result, these retaining systems contribute to a reduced life of the housings of the fluid section in a reciprocating pump, which thereby increases the overall costs for owning, operating, and maintaining such devices.

SUMMARY OF THE DISCLOSURE

In one or more exemplary embodiments disclosed herein, the valve assembly is configured and arranged such that it transfers stresses to locations within the housing of the fluid section that are distal from the locations that carry traditionally high stress concentrations. By employing such a valve retainer assembly, the useful life of the housing of the fluid section of a reciprocating pump may be increased, such that the costs of owning, operating, and maintaining such devices may be reduced.

Specifically, some embodiments are directed to a pump. In an embodiment, the pump includes a fluid section having a chamber therein, a suction valve assembly disposed within the chamber, and a plunger configured to reciprocate within the chamber along a plunger axis. In addition, the pump includes a retainer assembly configured to retain the suction valve assembly within the chamber. The retainer assembly includes a retainer including a pair of engagement arms extending along a single arm axis that extends in a direction that is perpendicular to the plunger axis. In addition, the retainer assembly includes a keeper including a connecting shaft. The retainer further includes a connecting member including a coupling aperture that receives the connecting shaft.

Other embodiments are directed to a valve retainer assembly. In an embodiment, the valve retainer assembly includes a retainer configured to engage with a suction valve assembly and retain the suction valve assembly within a chamber of a fluid section of a reciprocating pump. The retainer includes a pair of engagement arms extending along a single arm axis, and a connecting member including a coupling aperture. In addition, the valve retainer assembly includes a keeper that further includes a keeper axis, and a connecting shaft. The connecting shaft of the keeper is received within the coupling aperture such that the keeper axis extends in a direction that is perpendicular to the arm axis.

Still other embodiments are directed to a pump. In an embodiment, the pump includes a fluid section having a chamber therein. The chamber includes a first fluid passage extending along a first axis, and a second fluid passage extending along a second axis. The first axis is orthogonal to the second axis. In addition, the pump includes a plunger configured to reciprocate within second fluid passage along the second axis, an inlet disposed in the first fluid passage, and a suction valve assembly disposed within the first fluid passage. The suction valve assembly includes a valve seat secured within the first fluid passage, and a valve member configured to sealingly engage the valve seat. Further, the pump includes a retainer assembly configured to retain the suction valve assembly within the first fluid passage. The retainer assembly includes a retainer disposed within the first fluid passage. The retainer includes a central body, a pair of engagement arms extending from the central body along a single arm axis that extends in a direction that is perpendicular to the first axis and the second axis. The pair of engagement arms engage with a pair of engagement projections that extend radially inward toward the first axis within the first fluid passage. In addition, the retainer includes a connecting member including a coupling aperture extending therethrough. In addition, the retainer assembly includes a keeper disposed within the second fluid passage. The keeper includes a keeper axis, a first end, and a second end opposite the first end. In addition, the keeper includes a connecting shaft extending from the first end along the keeper axis, and an engagement member extending along the keeper axis from the connecting shaft to the second end. The connecting shaft of the keeper is received within the coupling aperture such that the keeper axis extends in a direction that is perpendicular to the arm axis, perpendicular to the first axis, and parallel to the second axis.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings.

BRIEF DESCRIPTION OF THE DRAWINGS

For a detailed description of various exemplary embodiments, reference will now be made to the accompanying drawings in which.

DETAILED DESCRIPTION OF DISCLOSED EXEMPLARY EMBODIMENTS

Figure 1:
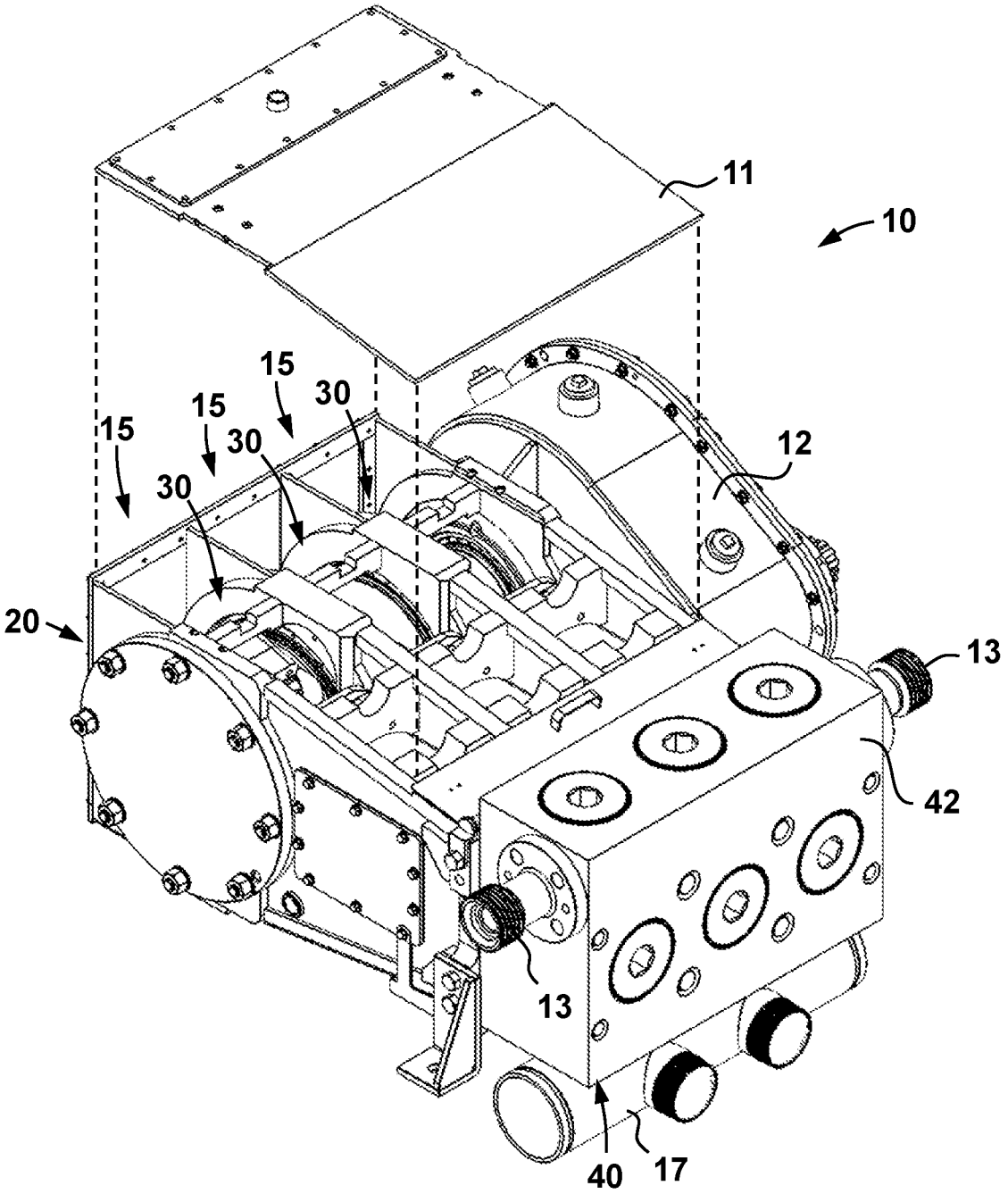
FIG. 1 is a perspective view of an embodiment of a reciprocating pump including a valve retainer assembly in accordance with the principles disclosed herein.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct engagement of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. As used herein, the terms "approximately," "generally," "substantially," "about" and the like mean plus or minus 10%.

Referring now to FIG. 1, there is shown a reciprocating pump 10 including a plurality of valve retainer assemblies (not shown in FIG. 1) in accordance with the principles disclosed herein. In this embodiment, pump 10 is utilized to pump fluids from the surface into a subterranean wellbore or borehole in order to carry out downhole operation, such as, for example, cementing or formation fracturing; however, it should be appreciated that pump 10 may be utilized in a wide array of industries and applications. Pump 10 includes a driver assembly 12 that provides rotative power to a plurality of pumping units 15 arranged adjacent one another within pump 10 (note that pump 10 is shown in FIG. 1 with a top cover plate 11 removed so as to reveal the pumping units 15 disposed therein). In this embodiment, driver assembly 12 includes a gear box that is operatively coupled to a motor; however, any suitable driving mechanism or assembly may be used to provide rotative to pumping units 15. In this embodiment, pump 10 includes a total of three pumping units 15 that are each energized by driver assembly 12 to draw in fluid from a suction manifold 17 and discharge the fluid from one or more outlet ports 13 (in this embodiment, pump 10 includes two outlet ports 13).

Figure 2:
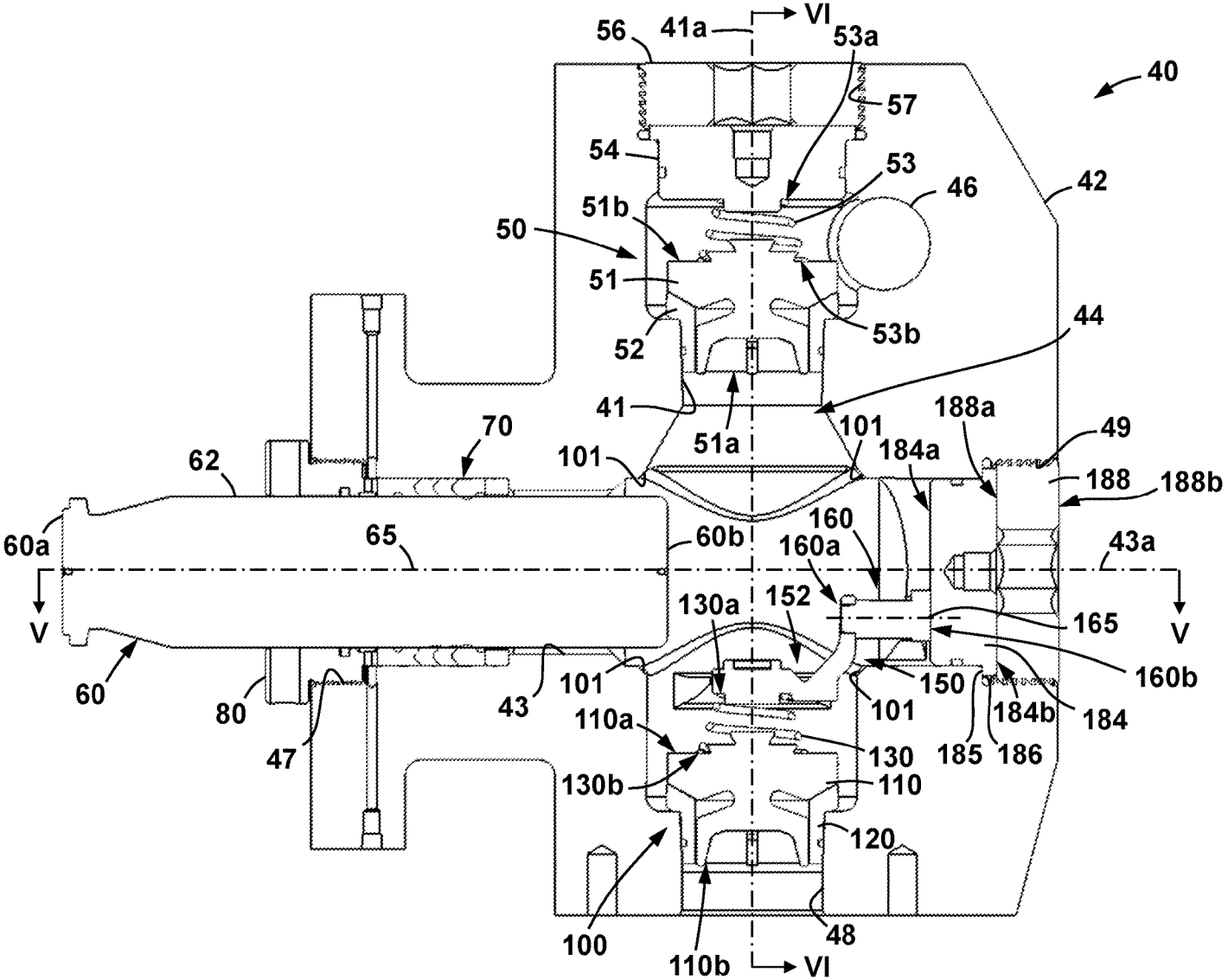
FIG. 2 is a side cross-sectional view of the fluid section and plunger of a single pumping unit disposed within the reciprocating pump of FIG. 1.

Referring now to FIGS. 1 and 2, each pumping unit 15 of pump 10 includes a power end or section 20, a fluid end or section 40, a plunger 60 (see FIG. 2) extending between sections 20, 40, (note: only fluid section 40 and plunger 60 of one pumping unit 15 of pump 10 is shown in FIG. 2; however, it should be appreciated that fluid section 40 and plunger 60 of each such pumping unit 15 is similarly arranged). Power section 20 includes a cranking mechanism 30 (see FIG. 1) that is coupled to plunger 60 to drive reciprocation thereof during operations. For example, in some embodiments, cranking mechanism 30 includes a crankshaft, a connecting rod, and a crosshead each being similarly configured and arranged as described in U.S. patent application Ser. No. 14/536,272, the entire contents of which are incorporated herein by reference in their entirety for all purposes.

Fluid section 40 includes a main body 42 having an inner chamber 44 defined by a first fluid passage 41 extending along a first axis 41*a*, and a second fluid passage 43 extending along a second axis 43*a*. Passages 41, 43 are arranged and oriented such that axes 41*a*, 43*a* are orthogonal (i.e., perpendicular) to one another; however, other arrangements and orientations are possible in other embodiments. In addition, chamber 44 further includes an inlet 48 disposed along first fluid passage 41 that is in fluid communication with manifold 17 (see FIG. 1), an outlet 46 in fluid communication with each of the first fluid passage 41 and one or both of the outlet ports 13 (See FIG. 1). Further, chamber 44 includes a pair of access ports 47, 49 disposed along second fluid passage 43.

A suction valve assembly 100 is disposed within first fluid passage 41 of chamber 44, proximate the inlet 48 and is configured to control fluid flow from the manifold 17, through inlet 48, and into chamber 44. In addition, a discharge valve assembly 50 is disposed within first fluid passage 41 of chamber 44, proximate the outlet 46 and is configured to control fluid flow from chamber 44 to the outlet ports 13, through outlet 46.

Referring specifically to FIG. 2, suction valve assembly 100 includes a valve member 110, a valve seat 120, a biasing member 130, and a valve retainer assembly 150. Valve member 110 includes a first or inner side 110*a* and a second or outer side 110*b* opposite inner side 110*a*. Valve seat 120 is secured within first fluid passage 41 of chamber 44 proximate inlet 48. In some embodiments, valve seat 120 may be integrally formed within first fluid passage 41. Biasing member 130 includes a first end 130*a*, and a second end 130*b* opposite first end 130*a*. In this embodiment, biasing member 130 comprises a coiled spring; however, any other suitable biasing member (e.g., leaf spring, piston, etc.) may be used in other embodiments. As shown in FIG. 2, valve member 110 is engaged with valve seat 120 such that outer side 110*b* is in fluid communication with inlet 48 of main body 42, and inner side 110*a* is in fluid communication with second fluid passage 43 of chamber 44. In addition, biasing member 130 is disposed and compressed axially between valve member 110 and valve retainer assembly 150 along axis 41*a*. Specifically, first end 130*a* of biasing member 130 is engaged with valve retainer assembly 150 and second end 130*b* is engaged with inner side 110*a* of valve member 110. The structural details of valve retainer assembly 150 will be described in more detail below; however, it should be appreciated initially that valve retainer assembly 150 is secured within chamber 44 such that when biasing member 130 is compressed between valve retainer assembly 150 and inner side 110*a* of valve member 110, biasing member 130 exerts a biasing force onto valve member 110 to urge valve member 110 axially toward inlet 48 along axis 41*a* and into sealing engagement with valve seat 120. As used herein, the phrase "sealing engagement" is used to denote contact or an engagement between surfaces, components, or members that prevents the flow of fluid (e.g., gas or liquid) therebetween. As a result, when valve member 110 is in sealing engagement with valve seat 120 as described above, the second fluid passage 43 of chamber 44 and inlet 48 are not in fluid communication with one another (i.e., second fluid passage 43 and inlet 48 are fluidly isolated).

During operations, if the pressure difference between second fluid passage 43 and inlet 48 is insufficient to overcome the biasing force exerted by biasing member 130, the suction valve assembly 100 will remain in a closed position such that valve member 110 maintains sealing engagement with valve seat 120. However, if the pressure within second fluid passage 43 of chamber 44 is sufficiently lower than the pressure at inlet 48, suction valve assembly 100 will transition from the closed position to an open position. Specifically, when transitioning from the closed position to the open position, valve member 110 moves axially toward second fluid passage 43 along axis 41*a* against the biasing force exerted by biasing member 130, such that ends 130*a*, 130*b* of biasing member 130 are axially compressed toward one another along axis 41*a*, and valve member 110 is disengaged from valve seat 120, thereby placing second fluid passage 43 and inlet 48 in fluid communication.

Referring still to FIG. 2, discharge valve assembly 50 includes a valve member 51, a valve seat 52, and a biasing member 53. Valve member 51 includes a first or inner side 51*a* and a second or outer side 51*b* opposite inner side 51*a*. Valve seat 52 is secured within first fluid passage 41 of chamber 44 proximate outlet 46. In some embodiments, valve seat 52 may be integrally formed within first fluid passage 41. Biasing member 53 includes a first end 53*a*, and a second end 53*b* opposite first end 53*a*. In this embodiment, biasing member 53 comprises a coiled spring; however, any other suitable biasing member (e.g., leaf spring, piston, etc.) may be used in other embodiments. As shown in FIG. 2, valve member 51 is engaged with valve seat 52 such that outer side 52*b* is in fluid communication with outlet 46 of main body 42, and inner side 51*a* is in fluid communication with second fluid passage 43 of chamber 44. In addition, biasing member 53 is disposed and compressed axially along axis 41*a* between valve member 51 and a plug or cover 54, which is further secured within a port 57 of main body 42 via a retaining nut 56. Specifically, first end 53*a* of biasing member 53 is engaged with cover 54 and second end 53*b* is engaged with outer side 51*b* of valve member 51. Because cover 54 is secured within port 57 of main body 42 via retaining nut 56 as previously described, when biasing member 53 is axially compressed between cover 54 and outer side 51*b* of valve member 51 along axis 41*a*, biasing member 53 exerts a biasing force on valve member 51 to urge valve member 51 axially toward second fluid passage 43 of chamber 44 and therefore into sealing engagement with valve seat 52. As a result, when valve member 51 is in sealing engagement with valve seat 52 as described above, second fluid passage 43 and outlet 46 are not in fluid communication with one another (i.e., second fluid passage 43 and outlet 46 are fluidly isolated).

During operations, if the pressure difference between second fluid passage 43 and outlet 46 is insufficient to overcome the biasing force exerted by biasing member 53, the discharge valve assembly 50 will remain in a closed position such that valve member 51 maintains sealing engagement with valve seat 52. However, if the pressure within second fluid passage 43 of chamber 44 is sufficiently higher than the pressure at outlet 46, discharge valve assembly 50 will transition from the closed position to an open position. Specifically, when transitioning from the closed position to the open position, valve member 51 moves axially away from second fluid passage 43 along axis 41*a* against the biasing force exerted by biasing member 130, such that ends 53*a*, 53*b* of biasing member 53 are axially compressed toward one another along axis 41*a*, and valve member 51 is disengaged from valve seat 52, thereby placing second fluid passage 43 and outlet 46 in fluid communication.

Referring still to FIG. 2, plunger 60 is an elongate generally cylindrical member that has a central longitudinal plunger axis 65 (which may be referred to herein as a "plunger axis"), a first or power end 60*a* a second or fluid end 60*b* opposite the power end 60*a*, and a radially outer surface 62 extending axially between ends 60*a*, 60*b*. Power end 60*a* extends through both access port 47 in main body 42 and through an aperture or access port within an outer wall (not shown) enclosing power section 20 such that end 20*a* may be connected to cranking mechanism 30. As a result, fluid end 60*b* is disposed within second fluid passage 43 of chamber 44 of main body 42 such that axis 65 of plunger 60 is aligned with axis 43*a* of second fluid passage 43.

Referring now to FIGS. 1 and 2, driver assembly 12 simultaneously imparts rotative energy to each of the pumping units 15 to facilitate pumping operations from pump 10, with each of the pumping units 15 in this embodiment operating approximately 120° out of phase with one another to produce a relatively constant supply of pressurized fluid from outlet ports 13. Specifically, considering the operations of only a single pumping unit 15 with reference to FIGS. 1 and 2, power end 60*a* of plunger 60 is coupled to cranking mechanism 30 and fluid end 60*b* of plunger 60 is inserted into second fluid passage 43 through access port 47 as previously described. Thereafter, the driver assembly 12 drives rotation of cranking mechanism 30, which in turn causes reciprocation of plunger 60 along the axis 43*a* within second fluid passage 43 of chamber 44. Each time fluid end 60*b* of plunger strokes back within second fluid passage 43 along axis 43*a* (i.e., toward the left as shown in FIG. 2), a vacuum is created therein which causes discharge valve assembly 50 to assume the closed position and suction valve assembly 100 to assume the open position in the manner previously described above. As a result, when plunger 60 strokes back within second fluid passage 43, fluids are drawn in from suction manifold 17, through inlet 48, and into chamber 44 (specifically second fluid passage 43). Therefore, such a stroke of plunger 60 may be referred to herein as a suction stroke. Conversely, each time fluid end 60*b* strokes out within second fluid passage 43 along axis 43*a* (i.e., to the right as shown in FIG. 2), the pressure within second fluid passage 43 increases, which causes suction valve assembly 100 to transition to the closed position and discharge valve assembly 50 to transition to the open position in the manner previously described above. As a result, when plunger 60 strokes out within second fluid passage 43, the fluids within passage 43 are pressurized and forced out of chamber 44 through outlet 46, and into one or both of the outlet ports 13 (See FIG. 1). Therefore, such a stroke of plunger 60 may be referred to herein as a discharge stroke.

During the reciprocation of plunger 60 described above, pressurized fluid is primarily restricted from flowing out of chamber 44 (particularly second fluid passage 43) along the radially outer surface 62 of plunger 60 through access port 47 with a packing assembly 70 that is disposed about plunger 60. Packing assembly 70 is secured within port 47 with a threaded gland nut 80 that is also concentrically disposed about plunger 60.

In addition, during the reciprocation of plunger 60 and the pumping of fluid through chamber 44 described above, main body 42 experiences stresses from a variety of sources, including, for example, the pressurized fluid flowing within chamber 44. Conventional retainer assemblies engage with main body 42 (e.g., through engagement shoulders or other geometries within main body 42) at or near the transitions or corners 101 extending between first fluid passage 41 and second fluid passage 43 thereby inducing stress concentrations at corners 101. As a result of these stress concentrations, main body 42 typically experiences failures (e.g., cracking, fracturing, etc.) at corners 101 during operations. Accordingly, as will be described in more detail below, valve retainer assembly 150 engages with first fluid passage 41 at points and locations that are distal from corners 101, such that the stress concentrations at corners 101 may be reduced or eliminated during pumping operations. The structural details of valve retainer assembly 150 and the installation of valve retainer assembly 150 within chamber 44 are described in more detail below to promote further understanding of the benefits and function provided by valve retainer assembly 150 within reciprocating pump 10.

Figure 3:
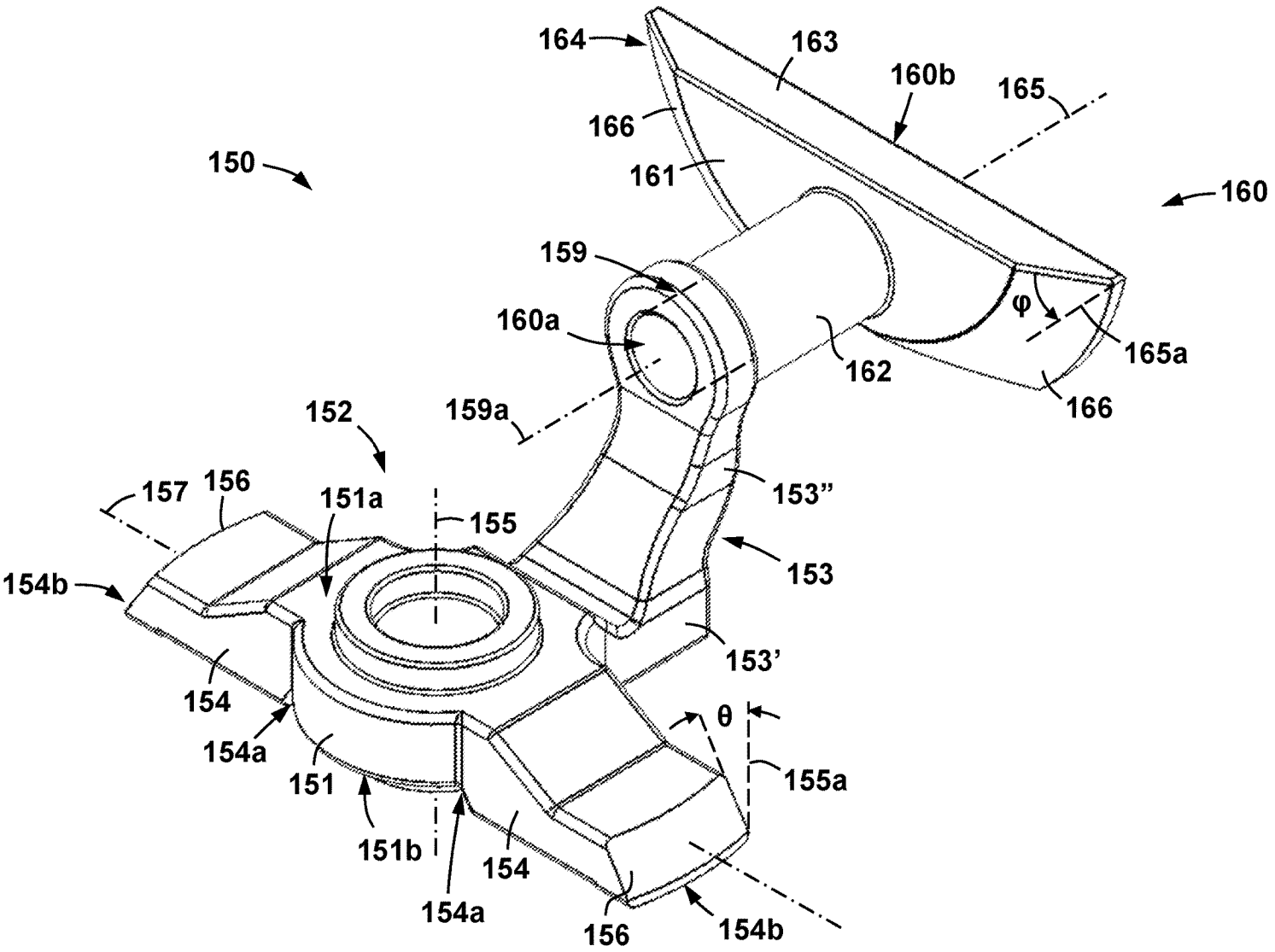
FIGS. 3 and 4 are perspective views of a valve retainer assembly for use within the reciprocating pump of FIG. 1 in accordance with at least some embodiments disclosed herein.
Figure 4:
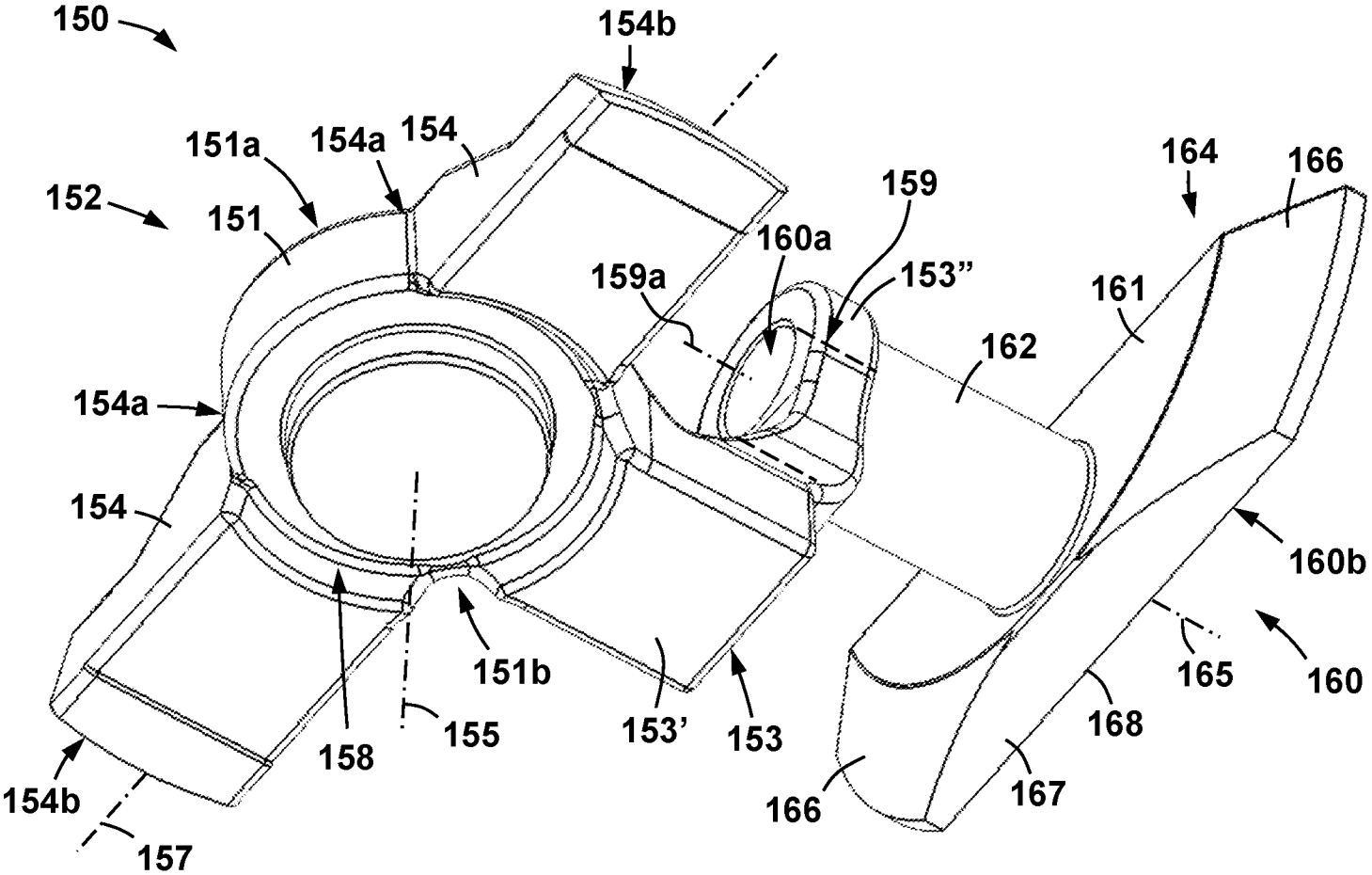

Referring now to FIGS. 3 and 4, valve retainer assembly 150 includes a retainer 152 and a keeper 160 coupled to retainer 152. Retainer 152 includes a central body 151 that is generally cylindrical in shape and includes a central axis 155, a first or upper side 152*a*, and a second or lower side 152*b* opposite upper side 152*a*. A pair of engagement arms 154 extends radially outward from central body 151 along an axis 157 that is orthogonal to axis 155 of central body 151. As used herein, axis 155 may be referred to herein as a "body axis", and axis 157 may be referred to herein as an "arm axis." As a result, engagement arms 154 are radially opposite one another about axis 155 (i.e., each arm 154 is circumferentially spaced from the other arm 154 approximately 180° about axis 155). Each engagement arm 154 includes a first or proximal end 154*a* at body 151 and a second or distal end 154*b* extended away from body 151 along axis 157. Distal end 154*b* of each arm 154 includes a frustoconical engagement surface 156 that tapers at an angle θ (see FIG. 3) relative to axis 155 (see line 155*a* in FIG. 3 that is parallel to axis 155). In some embodiments, the angle θ is between 0° and 90°, inclusive, and in other embodiments, the angle θ is between 15° and 75°, inclusive. In addition, as is best shown in FIG. 4, central body 151 of retainer 152 includes an annular groove or recess 158 extending generally axially inward from lower side 152*b* with respect to axis 155. As will be described in more detail below, groove 158 receives first end 130*a* of biasing member 130 during operations.

Further, retainer 152 also includes a connecting member 153 coupled to central body 151. Connecting member 153 includes a first portion 153' projecting generally radially outward from central body 151 with respect to axis 155, and a second portion 153" extending generally axially from first portion 153' with respect to axis 155. Second portion 153" includes a coupling aperture 159 extending therethrough along an axis 159*a* that is disposed within a plane (note: the plane is not specifically shown in FIGS. 3 and 4) that also includes the axis 155. As used herein, the axis 159*a* may be referred to herein as an "aperture axis." Thus axes 159*a*, 155 together define a plane (not shown) that extends perpendicularly through axis 157 of engagement arms 154.

Referring still to FIGS. 3 and 4, keeper 160 includes a central or longitudinal axis 165 (which may be referred to herein as a "keeper axis"), a first end 160*a*, a second end 160*b* opposite first end 160*a*, a connecting shaft 162 extending axially from first end 160*a* along axis 165, and an engagement member 164 extending from connecting shaft 162 to second end 160*b*. Engagement member 164 includes a pair of frustoconical engagement surfaces 166 that taper relative to axis 165 at an angle φ (see line segment 165*a* in FIG. 3 that is parallel to axis 165). In some embodiments, the angle φ is between 0° and 90°, inclusive, and in other embodiments, the angle φ is between 15° and 75°, inclusive. Each of the frustoconical surfaces 166 are separated by a generally radially extending planar surface 163 (see FIG. 3) on one side of engagement member 164 and by a generally radially extending planar surface 167 (see FIG. 4) on an opposing side of engagement member 164. In this embodiment, planar surfaces 163, 167 radially oppose one another about axis 165 (i.e., are spaced 180° from one another about axis 165). In addition, planar surfaces 163, 167 are parallel to one another such that each planar surface 163, 167 extends perpendicularly through a plane including the axis 165. Also, planar surfaces 163, 167 are radially opposite one another with about axis 165. Further, engagement member 164 also includes a planar surface 161 extending radially between planar surfaces 163, 167 and radially between frustoconical engagement surfaces 166, and further includes a planar surface 168 extending radially between planar surface 163, 167. Planar surfaces 161, 168 are parallel and axially spaced from one another along axis 165, and each surface 161, 168 extends in a direction that is perpendicular to surfaces 163, 167. Thus, planar surfaces 161, 168 extend perpendicularly through a plane including the axes 159*a*, 165, 155 and parallel to a plane including the axes 155, 157 when keeper 160 is coupled to retainer 152.

Connecting shaft 162 is a generally cylindrically shaped member that extends axially from engagement member 164 to first end 160*a*. As shown in FIGS. 3 and 4, one end of connecting shaft 162 is received within coupling aperture 159 on connecting member 153 of retainer 152, such that axis 165 of keeper 160 is aligned with axis 159*a* of aperture 159. In this embodiment, connecting shaft 162 is inserted within aperture 159 such that connecting shaft 162 (and therefore keeper 160) may rotate relative to retainer 152 about axis 165 (although, it should be appreciated that such relative rotation may be prevented when retainer assembly 150 is installed within chamber 44 as described herein). For example, connecting shaft 162 may be loosely fit within aperture 159.

Figure 5:
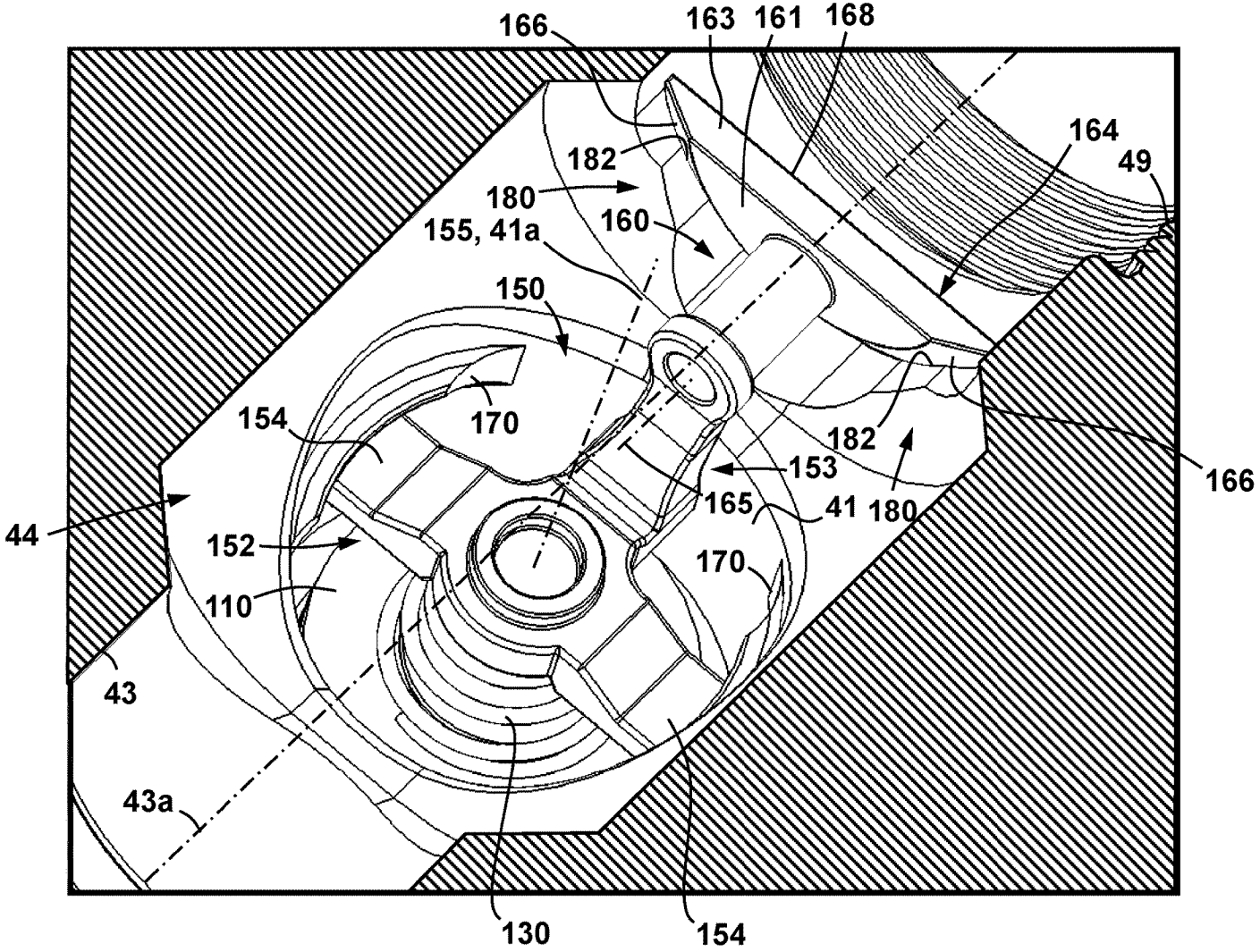
FIG. 5 is an enlarged perspective cross-sectional view taken along section V-V in FIG. 2.
Figure 6:
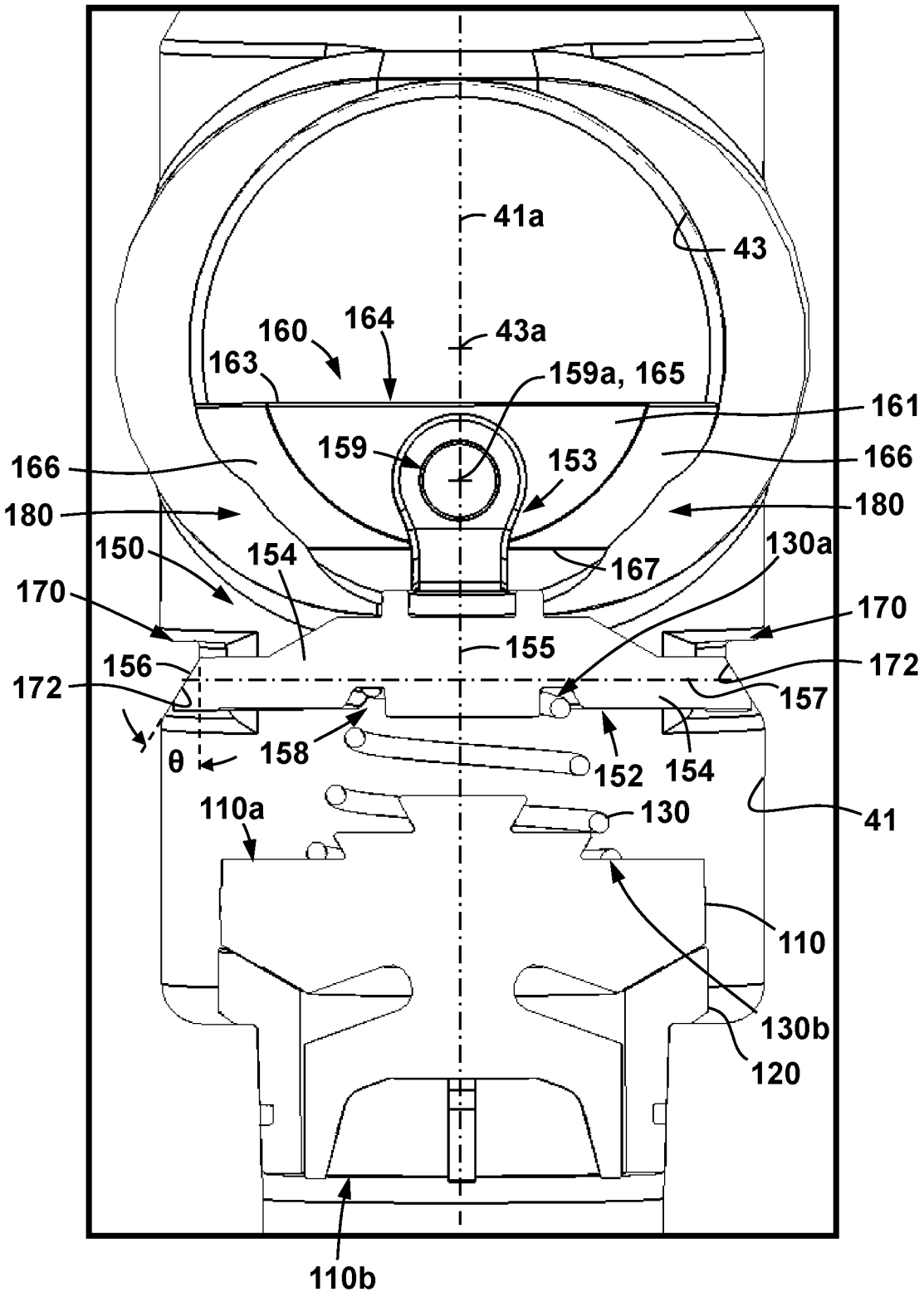
FIG. 6 is an enlarged cross-sectional view taken along section VI-VI in FIG. 2.

Referring now to FIGS. 5 and 6, when valve retainer assembly 150 is installed within chamber 44 of main body 42 of fluid section 40, retainer 152 is disposed within first fluid passage 41 proximate inlet 48, and keeper 160 is disposed within second fluid passage 43 proximate access port 49. As best shown in FIG. 6, first end 130*a* of biasing member 130 is received within groove 158 on lower end 151*b* of central body 151 such that biasing member 130 abuts and engages with central body 151 of retainer 152. As previously described, second end 130*b* of biasing member 130 is engaged with inner side 110*a* of valve member 110, and thus, biasing member 130 biases valve member 110 and retainer 152 axially apart from one another along axis 41*a* during operations in the manner previously described above.

In addition, each engagement arm 154 of retainer 152 engages or abuts one of a pair of arcuate engagement projections 170 extending radially inward within first fluid passage 41 with respect to axis 41*a*. As best shown in FIG. 6, each engagement projection 170 is formed within the first fluid passage 41 (and thus makes up a part of first fluid passage 41) and includes a frustoconical engagement surface 172 that engages with frustoconical engagement surfaces 156 on distal ends 154*b* of arms 154. Without being limited to this or any other theory, the engagement between frustoconical surfaces 156 on arms 154 and frustoconical surfaces 172 on engagement projections 170 helps to center retainer 152 within first fluid passage 41, such that axis 41*a* is generally aligned with axis 155 of central body 151. In addition, the engagement between frustoconical surfaces 172, 156 axially retains retainer 152 within first fluid passage 41 and thereby prevents axial movement of retainer 152 toward second fluid passage 43 (e.g., via the biasing force exerted on retainer 152 by biasing member 130). As is also best shown in FIG. 6, in this embodiment, frustoconical surfaces 172 taper relative to axis 41*a* at the same angle as the taper of frustoconical surfaces 156 relative to axis 155 on retainer 152. As a result, in this embodiment, frustoconical surfaces 172 taper relative to axis 41*a* at the angle θ, which may be any of the same values discussed above for angle θ of frustoconical surfaces 156 on arms 154.

Referring still to FIGS. 5 and 6, in this embodiment, each engagement projection 170 is disposed radially opposite the other engagement projection 170 about axis 41*a* such that engagement projections 170 oppose one another across a plane (note shown) including the central axis 43*a* of second fluid passage 43. As a result, when valve retainer assembly 150 is installed within chamber 44 as shown in FIGS. 5 and 6, axis 157 of retainer 152 (which defines the directions of engagement arms 154) extends in a direction that is generally perpendicular to axis 41*a*, and that is generally perpendicular to a plane (not shown) including the axis 43*a* of second fluid passage 43 and the axis 65 of plunger 60 (see FIG. 2). Stated another way, when valve retainer assembly 150 is installed within chamber 44 as shown, axis 157 of retainer 152 extends perpendicularly to the direction of reciprocation of plunger 60 (which is along axes 43*a*, 65—see FIG. 2). In addition, in this embodiment, each engagement projection 170 extends 70° or less about axis 41*a* along the inner wall of first fluid passage 41. In other embodiments, each engagement projection extends 50° or less about axis 41*a* along the inner wall of first fluid passage 41.

During operations, retainer 152 is installed within first fluid passage 41 to engage with engagement projections 170 and biasing member 130 is compressed between retainer 152 and valve member 110 as previously described. Because engagement projections 170 oppose one another across a plane (not shown) including axis 43*a* of second fluid passage 43 as previously described, engagement projections 170 are distal from corners 101 at the transitions between fluids passages 41, 43. As a result, engagement of the retainer 152 with engagement projections 170 does not cause stress concentrations at corners 101 within main body 42 such that the operational life main body 42 may be increased.

Figure 7:
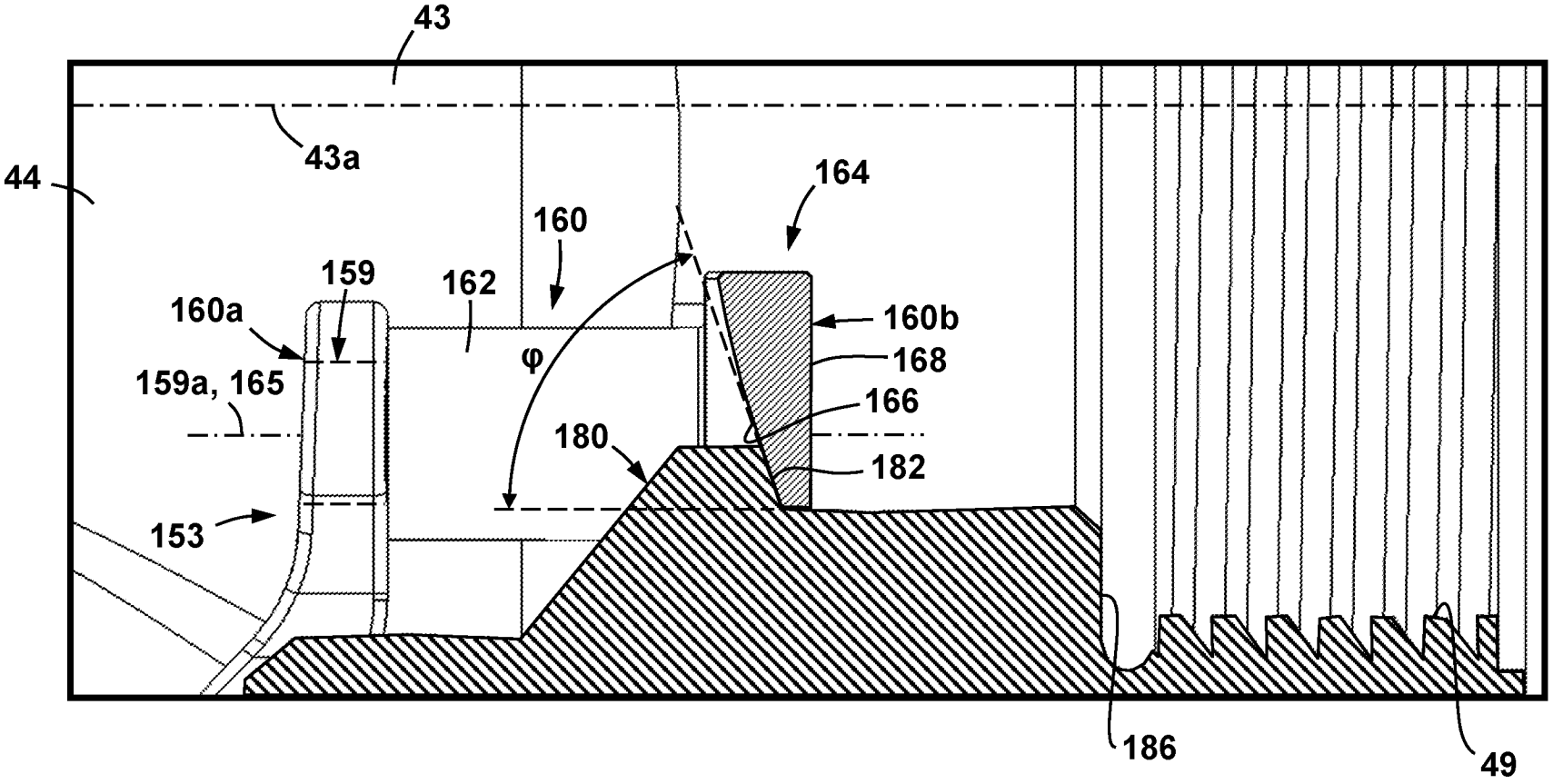
FIG. 7 is an enlarged side cross-section view of the fluid section of FIG. 2 depicting the engagement between the keeper of the valve retainer assembly of FIG. 2 and the second fluid passage of the fluid section.

Referring now to FIGS. 5 and 7, when valve retainer assembly 150 is installed within chamber 44 of main body 42 of fluid end 40, keeper 160 (and particularly engagement member 164) is disposed within second fluid passage 43 proximate access port 49 as previously described. Specifically, each of the frustoconical engagement surfaces 166 engages or abuts one of a pair of engagement projections 180 extending radially inward within second fluid passage 43 with respect to axis 43*a*. As best appreciated from FIGS. 5 and 6, in this embodiment each engagement projection 180 extends 330° or less about axis 43*a* along the inner wall of second fluid passage 43. In some embodiments, no engagement projection 180 extends within either an approximately 15° section proximate the bottom of passage 43 or an approximately 15° section proximate the top of passage 43 (i.e., no engagement projection 180 extends within either an approximately 15° section proximate the 12 o'clock position or an approximately 15° section proximate the 6 o'clock position within passage 43 when passage 43 is viewed along axis 43—see FIG. 6). In addition, as is also best appreciated from FIGS. 5 and 6, in this embodiment engagement projections 180 are symmetrically arranged about a plane including the axes 41*a*, 43*a*. Specifically, in this embodiment, each engagement projection 180 is a mirror image of the other engagement projection 180 about the plane including the axes 41*a*, 43*a*. In at least some embodiments, when keeper 160 (particularly engagement member 164) is disposed within second fluid passage 43, engagement member 164 is arranged such that planar surfaces 163, 167 are perpendicular to a plane including the axes 41*a*, 43*a*.

As best shown in FIG. 7, each engagement projection 180 includes a frustoconical engagement surface 182 that engages with frustoconical engagement surfaces 166 on keeper 160. Without being limited to this or any other theory, the engagement between frustoconical surfaces 166 on engagement member 164 of keeper 160 and frustoconical surfaces 182 on engagement projections 180 aligns and retains keeper 160 within second fluid passage 43, such that axis 165 of keeper 160 is parallel to and radially spaced from axis 43*a* of second fluid passage 43 (see also FIG. 6). In this embodiment, the engagement between frustoconical surfaces 166, 182 aligns and retainers keeper 160 within second fluid passage 43 such that axis 165 of keeper 160 is parallel to axis 43*a* of second fluid passage 43 and axis 165 is axially spaced from axis 43*a* along axis 41*a* of first fluid passage 41 (i.e., axes 165, 43*a* each extend perpendicularly through axis 41*a*). As is also best shown in FIG. 7, in this embodiment, frustoconical surfaces 182 taper relative to axis 165 of keeper 160 (when keeper 160 is installed within passage 43 and surfaces 166, 182 are engaged as shown) at the same angle as the taper of frustoconical surfaces 166 relative to axis 165. As a result, in this embodiment, frustoconical surfaces 182 taper relative to an axis (e.g., axis 165 when keeper 160 is installed within passage 43) that is parallel to and radially offset from axis 43*a* at the angle φ, which may be any of the same values discussed above for angle φ of frustoconical surfaces 166 on engagement member of keeper 160.

Referring again to FIG. 2, a cylindrical plug or cover 184 is disposed within second fluid passage 43. Cover 184 includes a first end 184*a*, and a second end 184*b* opposite first end 184*a*, and a radially extending shoulder 185 disposed between ends 184*a*, 184*b*. When cover 184 is inserted within second fluid passage 43, first end 184*a* engages or abuts with second end 160*b* of keeper 160, and shoulder 185 engages or abuts a corresponding shoulder 186 extending within second fluid passage 43 proximate access port 49. A threaded retaining nut 188 is then threadably engaged within port 49 to secure both cover 184 and keeper 160 within second fluid passage 43. Specifically, retaining nut 188 includes a first end 188*a*, and a second end 188*b* opposite first end 188*a*. When retaining nut 188 is threadably engaged within port 49 (e.g., as shown in FIG. 2), first end 188*a* engages or abuts second end 184*b* of cover 184. Thus, when nut 188 is threadably secured within port 49, shoulder 185 of cover 184 is axially compressed against shoulder 186 in passage 43, first end 184*a* of cover 184 is axially compressed against second end 160*b* of keeper 160, and frustoconical surfaces 166 on engagement member 164 of keeper 160 are axially compressed against frustoconical surfaces 182 on engagement projections 180. Thus, the installation of retainer nut 180 within port 49 secures keeper 160 within second fluid passage 43.

Referring now to FIGS. 1, 2, 5, and 6, during pumping operations, plunger 60 is reciprocated along the aligned axes 65, 43*a* by cranking mechanism 30 to causing the pumping of fluid through main body 42 as previously described. During these operations, stresses (e.g., from the pressurized fluid flowing within chamber 44) are borne by main body 42. However, because engagement projections 170 are arranged distal to corners 101 between fluid passages 41, 43 as previously described, stress concentrations at corners 101 may be reduced or eliminated such that the operational life of main body 42 may be increased.

While embodiments of the reciprocating pump 10 disclosed here have included three pumping units 15, it should be appreciated that other embodiments of pump 10 may include more or less than three pumping units 15. For example, in some embodiments, pump 10 may include two pumping units 15 or one pumping unit 15, and in other embodiments, pump 10 may include four or more pumping units 15 (e.g., five pumping units 15). In addition, while the disclosed embodiments of central body 151 of retainer 152 include an annular groove 158, it should be appreciated that in other embodiments, no groove 158 is included such that the lower side of central body 151 is defined a planar surface. Further, while main body 42 of pump 10 has been shown as a single monolithic piece, it should be appreciated that main body 42 may comprise segmented modules coupled to one another in other embodiments. Still further, in some embodiments, keeper 160 may be integrally formed with plug 184.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention that is claimed below. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A pump, comprising:
a fluid section having a chamber therein;
a suction valve assembly disposed within the chamber;
a plunger configured to reciprocate within the chamber along a plunger axis; and
a retainer assembly configured to retain the suction valve assembly within the chamber, the retainer assembly comprising:
a retainer including a central body having a body axis, and a pair of engagement arms extending along a single arm axis that extends in a direction that is perpendicular to the plunger axis; and
a keeper including a connecting shaft;
wherein the retainer further includes a connecting member having a first portion projecting radially outward from the central body perpendicular to the body axis, the connecting member including a coupling aperture that receives the connecting shaft.

2. The pump of claim 1, wherein the chamber comprises:
a first fluid passage extending along a first axis; and
a second fluid passage extending along a second axis;
wherein the first axis is orthogonal to the second axis;
wherein the retainer and suction valve assembly are disposed within the first fluid passage; and
wherein the keeper is disposed within the second fluid passage.

3. The pump of claim 1, wherein each engagement arm includes a frustoconical surface that is configured to engage with a corresponding second frustoconical surface within the chamber.

4. The pump of claim 3, wherein each second frustoconical surface is disposed on an engagement projection extending from an inner wall of the chamber.

5. The pump of claim 3,
wherein each engagement arm includes a proximal end at the central body and a distal end positioned away from body along the arm axis; and
wherein, for each engagement arm, the frustoconical surface is disposed at the distal end.

6. The pump of claim 5, wherein the body axis is orthogonal to the arm axis; and
wherein the coupling aperture extends along an aperture axis that is perpendicular to each of the body axis and the arm axis; and
wherein the chamber comprises:
a first fluid passage extending along a first axis; and
a second fluid passage extending along a second axis;
wherein the first axis is orthogonal to the second axis;
wherein the retainer and suction valve are disposed within the first fluid passage; and
wherein the keeper is disposed within the second fluid passage.

7. The pump of claim 6, wherein the keeper further comprises:
a keeper axis; and
an engagement member;
wherein the engagement member comprises:
a pair of frustoconical surfaces;
a first planar surface extending between the pair of frustoconical surface; and
a second planar surface extending between the pair of frustoconical surfaces;
wherein the first planar surface is radially opposite the second planar surface about the keeper axis; and
wherein first planar surface and the second planar surface extend perpendicularly through a plane including the first axis and the second axis.

8. The pump of claim 6, wherein when the retainer assembly is disposed within the chamber:
the body axis is aligned with the first axis; and
the aperture axis is parallel to and radially spaced from the second axis.

9. The pump of claim 8, wherein the suction valve assembly comprises:

a valve member; and a biasing member engaging each of the valve member and the retainer.

10. A valve retainer assembly, comprising:

a retainer configured to engage with a suction valve assembly and retain the suction valve assembly within a chamber of a fluid section of a reciprocating pump, the retainer comprising:

a central body having a body axis;

a pair of engagement arms extending along a single arm axis; and a connecting member including a first portion projecting radially outward from the central body perpendicular to the body axis, and a coupling aperture; and a keeper comprising:

a keeper axis; and a connecting shaft extending along the keeper axis;

wherein the connecting shaft of the keeper is received within the coupling aperture such that the keeper axis extends in a direction that is perpendicular to the arm axis.

11. The valve retainer assembly of claim 10, wherein each engagement arm includes a proximal end at the central body and a distal end positioned away from the central body along the arm axis; and wherein each engagement arm includes a frustoconical surface at the distal end.

12. The valve retainer assembly of claim 11, wherein the body axis is orthogonal to the arm axis; and wherein the connecting member comprises:

a second portion extending from the first portion; and wherein the coupling aperture extends through the second portion of the connecting member.

13. The valve retainer assembly of claim 12, wherein the frustoconical surface on each engagement arm tapers radially inward toward the body axis at an angle $\theta$ that is between 0° and 90°.

14. The valve retainer assembly of claim 11, wherein the keeper further comprises an engagement member including one or more frustoconical surfaces thereon.

15. The valve retainer assembly of claim 14, wherein the keeper comprises:

a first end; and a second end opposite the first end;

wherein the connecting shaft extends along the keeper axis from the first end; and wherein the engagement member extends along the keeper axis from the connecting shaft to the second end.

16. The valve retainer of claim 15, wherein the one or more frustoconical surfaces on the engagement member taper radially inward toward the keeper axis at an angle $\varphi$ that is between 0° and 90°.

17. A pump, comprising:

a fluid section having a chamber therein, wherein the chamber comprises:

a first fluid passage extending along a first axis; and a second fluid passage extending along a second axis;

wherein the first axis is orthogonal to the second axis;

a plunger configured to reciprocate within second fluid passage along the second axis;

an inlet disposed in the first fluid passage;

a suction valve assembly disposed within the first fluid passage, wherein the suction valve assembly comprises:

a valve seat secured within the first fluid passage; and a valve member configured to sealingly engage the valve seat; and a retainer assembly configured to retain the suction valve assembly within the first fluid passage, the retainer assembly comprising:

a retainer disposed within the first fluid passage, wherein the retainer comprises:

a central body;

a pair of engagement arms extending from the central body along a single arm axis that extends in a direction that is perpendicular to the first axis and the second axis, wherein the pair of engagement arms engage with a pair of engagement projections that extend radially inward toward the first axis within the first fluid passage; and a connecting member extending radially outward away from the single arm axis and perpendicular to the first axis, and including a coupling aperture extending therethrough;

a keeper disposed within the second fluid passage, wherein the keeper includes a keeper axis, a first end, and a second end opposite the first end, and wherein the keeper comprises:

a connecting shaft extending from the first end along the keeper axis; and an engagement member extending along the keeper axis from the connecting shaft to the second end;

wherein the connecting shaft of the keeper is received within the coupling aperture such that the keeper axis extends in a direction that is perpendicular to the arm axis, perpendicular to the first axis, and parallel to the second axis.

18. The pump of claim 17, wherein the engagement member of the keeper includes one or more frustoconical surfaces that engage with one or more engagement projections extending within the second fluid passage.

19. The pump of claim 18, wherein the pair of engagement projections in the first fluid passage each include a frustoconical surface for engaging with the frustoconical surfaces on the distal ends of the pair of engagement arms; and wherein the one or more engagement projections in the second fluid passage each also includes a frustoconical surface for engaging with the one or more frustoconical surfaces on the engagement member of the keeper.

* * * * *